US007441508B2

(12) United States Patent
Faber et al.

(10) Patent No.: US 7,441,508 B2
(45) Date of Patent: Oct. 28, 2008

(54) MATTRESS EDGE SEWING MACHINE

(75) Inventors: Michael P. Faber, Crystal Lake, IL (US); Bob C. Turner, Hampshire, IL (US)

(73) Assignee: Union Special Corporation, Huntley, IL (US)

( * ) Notice: Subject to any disclaimer, the term of this patent is extended or adjusted under 35 U.S.C. 154(b) by 0 days.

(21) Appl. No.: 11/709,180

(22) Filed: Feb. 21, 2007

(65) Prior Publication Data

US 2007/0199488 A1 Aug. 30, 2007

Related U.S. Application Data

(60) Provisional application No. 60/777,664, filed on Feb. 28, 2006.

(51) Int. Cl.
*D05B 11/00* (2006.01)
*D05B 27/10* (2006.01)

(52) U.S. Cl. ..... 112/2.1; 112/322; 112/165

(58) Field of Classification Search ..... 112/7, 112/2.1, 303, 199, 220, 322, 200, 165, 176, 112/470.01, 470.12, 318, 221, 260
See application file for complete search history.

(56) References Cited

U.S. PATENT DOCUMENTS 3,285,211 A * 11/1966 Hayes et al. ..... 112/322
3,301,207 A * 1/1967 Reeber et al. ..... 112/200
4,186,676 A * 2/1980 Villa et al. ..... 112/165
5,501,164 A * 3/1996 Porter et al. ..... 112/176
5,540,162 A * 7/1996 Schopf et al. ..... 112/220
5,875,723 A * 3/1999 Lobur ..... 112/7
6,024,036 A * 2/2000 Miyachi et al. ..... 112/470.01
6,098,555 A * 8/2000 Sakuma ..... 112/165

* cited by examiner

*Primary Examiner*—Ismael Izaguirre
(74) *Attorney, Agent, or Firm*—Law Office of John W. Harbst

(57) ABSTRACT

A mattress edge sewing machine including a frame having a material supporting surface, a sewing station defined by a needle bar mounted in the frame for generally vertical reciprocatory movements along a fixed centerline, and a feeding mechanism for pulling material through the sewing station of the machine. The feeding mechanism includes upper and lower positively driven feed rollers which are continually biased into operable engagement with each other. The feed rollers are arranged less than 0.8625 inches, measured in the direction of material advancement, separates the centerline of the feed rollers from the centerline of the needle bar. The needle bar is moved in timed relation relative to the movements of the looper, and with the needle bar traversing a distance in a single vertical direction at a ratio greater than 3:1 relative to the distance in a single lateral direction traversed by the looper.

23 Claims, 12 Drawing Sheets

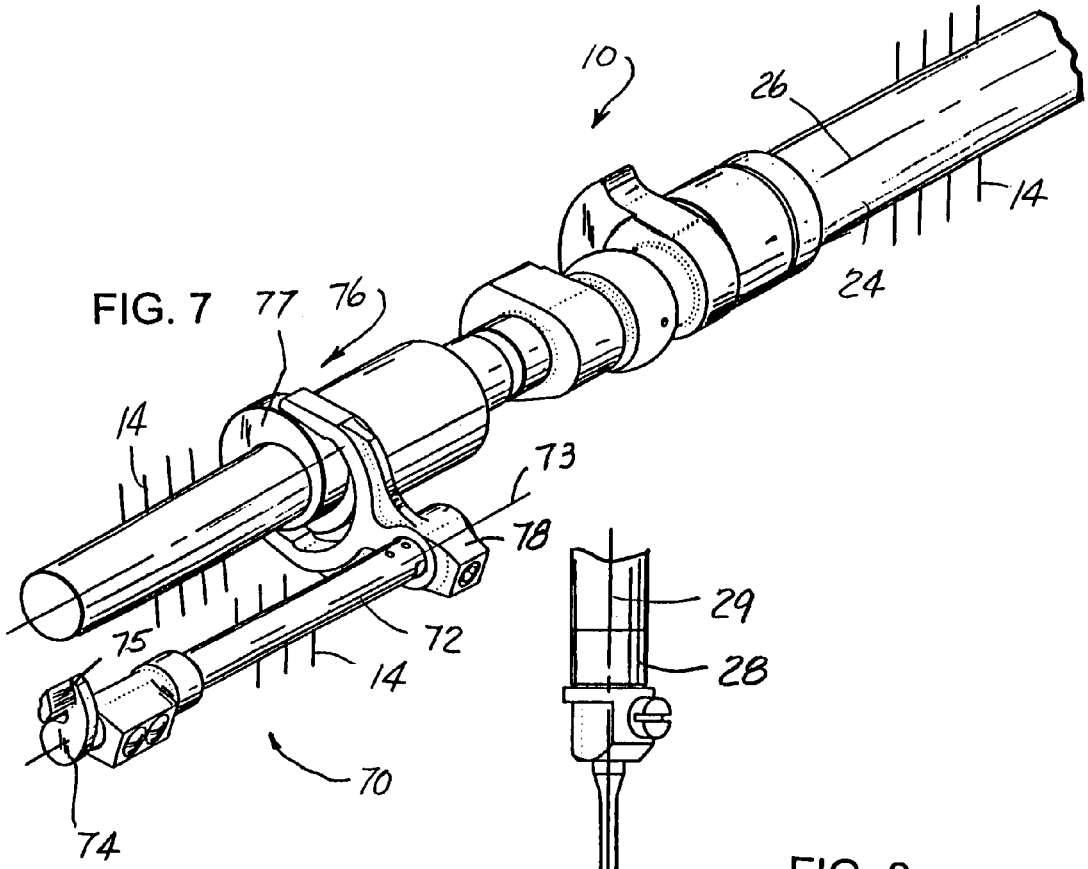
FIG. 7
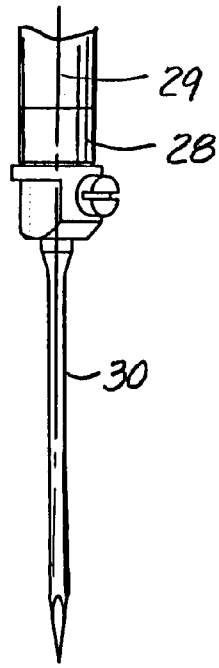
FIG. 8
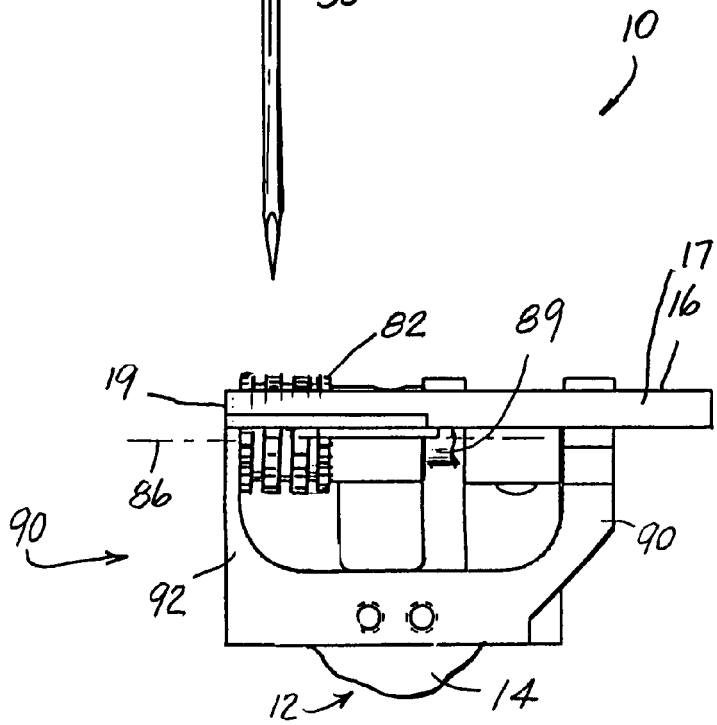

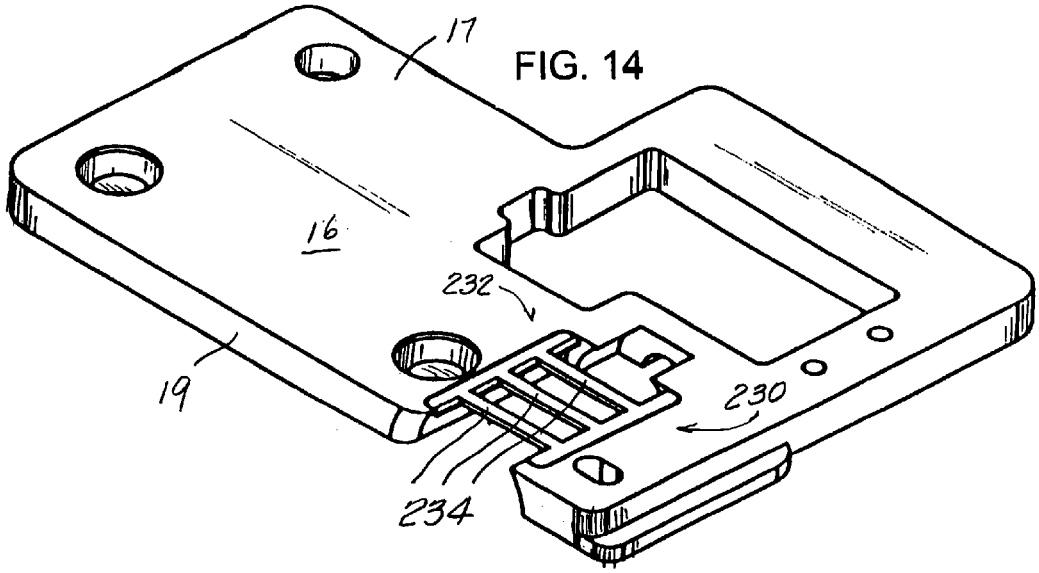
FIG. 14
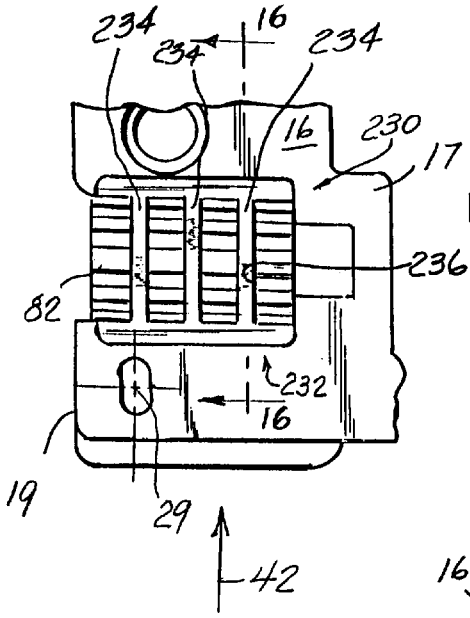
FIG. 15
FIG. 16
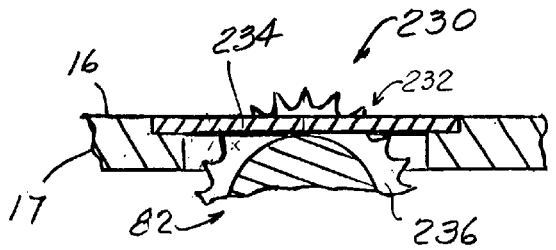

MATTRESS EDGE SEWING MACHINE

CROSS REFERENCE TO RELATED APPLICATION

This patent application claims the benefit of provisional patent application Ser. No. 60/777,664; filed Feb. 28, 2006.

FIELD OF THE INVENTION

The present invention generally relates to sewing machines and, more particularly to a mattress edge sewing machine having a roller feed mechanism for intermittently advancing material through stitch forming instrumentalities on the sewing machine including a thread carrying needle which travels at a ratio greater than 3:1 relative to a thread carrying looper arranged in operable combination with the needle.

BACKGROUND OF THE INVENTION

Specialized edge sewing and taping machines sew and secure peripheral edges of upper and lower mattress panels or a mattress cushion to the side panels thereof. During a mattress sewing operation, a sewing machine moves around a support relative to the mattress and performs a sewing operation about the periphery of the mattress. Chain-stitch sewing machines capable of sewing a Federal Stitch Type 401 are typically used for sewing mattress edges.

An operator, positioned adjacent to the sewing machine, compresses the mattress to create slack in the fabric panels or shell while continuously pulling an edge of the relative major face panel together with an edge of a side panel while also guiding the mattress into a stitch forming area of the sewing machine. In some applications, a steel wire or spring is arranged adjacent to the mattress seam. Moreover, and as the operator feeds the mattress panels into the sewing station, a narrow covering strip or tape is laid over the seam by a suitable and well known device and is sewn simultaneously with the seam. The strip or tape covers the seam and creates aesthetically acceptable upper and lower edges around the mattress periphery. It should be appreciated, the cumulative width of mattress materials fed into the sewing station of the machine can range in compressed thickness between about 0.187 inches and about 0.5 inches.

Mattress edge sewing and taping operations have generally required great manual effort due not only to the size and weight of the mattress but also to the constant compression the operator must apply to the mattress as well as the simultaneous tension the operator must apply to the panels mentioned above. This has been a special concern when sewing the four corners of the mattress which require extra handling and guidance efforts.

Especially when sewing an edge of a mattress, the reciprocal path of the sewing machine needle must be positioned as close as possible to a working edge of a throat plate on the sewing machine. A longer or a larger lateral distance between the path of the needle and the working edge of the sewing machine throat plate tends to allow materials, being advanced through the sewing station, to become removed from beneath the needle especially when a steel ring is arranged adjacent to the material edge being sewn Moreover, increasing the lateral distance between the path of the needle and the working edge of the throat plate proportionately increases problems involved with sewing a proper seam especially around the four corners of the mattress.

Any conventional chain-stitch sewing machine has sewing instrumentalities including a thread carrying needle and a thread carrying looper arranged in operable combination relative to each other. In such machines, the looper typically travels sideways or laterally across the path of the needle in a direction generally normal to the feeding direction of material. Because the path of the looper crosses the direction of material movement, sewing machines of this design only increase the distance between the path of the needle and the working edge of the throat plate.

Mattress edge sewing machines present a unique combination of characteristics which complicate the design thereof and are contrary to accepted and well known sewing standards. The needle on a standard chain-stitch sewing machine, between opposed ends of its stroke in a single vertical direction, travels about 1.5 times greater distance than does the looper between opposed ends of its travel in a generally lateral direction. The thickness of material having to be moved through a sewing station of a mattress edge sewing machine, however, requires the vertical travel of the needle to be significantly increased. Normally, the increased travel of the needle necessitates an increased lateral travel of the looper. Requiring the working edge of the throat plate to be positioned as close as possible to the reciprocal path of the needle, however, limits looper travel thus causing significant challenges in creating a proper chain stitch formation in a mattress edge sewing machine.

Primarily because of the thickness of material having to be feed through the machine, some mattress sewing machines have been known to use a needle feed machine. That is, a sewing machine wherein the sewing needle moves not only in a vertical path of travel but also moves with the material in the direction of material feed. As will be appreciated, designing a needle feed machine adds significantly to the cost of the machine manufacture and furthermore complicates the design of the sewing instrumentalities associated with such machine.

There are, however, significant material feeding problems associated with sewing a mattress edge simply because of the cumulative thickness of material to be moved through the sewing station of the machine. As will be appreciated, those sewing machines having a needle which reciprocally moves along a fixed path of travel have problems when considering the materials being fed through the machine have a cumulative width ranging between about 0.187 inches and about 0.50 inches. That is, if the material moving through the machine sewing station moves in the direction of feed with the needle in the work, significant damage can result to the needle, the needle bar, the needle bar drive mechanism and related sewing machine components.

Thus, there remains a need and desire for a mattress edge sewing machine which addresses the above-mentioned concerns and others while offering a low cost solution thereto.

SUMMARY OF THE INVENTION

According to one aspect, there is provided a mattress edge sewing machine including a frame with a drive shaft rotatably mounted therein and having a material supporting surface, a sewing station defined by sewing instrumentalities including a needle carried by a needle bar mounted in the frame for generally vertical reciprocatory movements along a fixed centerline and a looper reciprocally mounted for cooperative movements with the needle to form chain-stitches. The mattress edge sewing machine further includes a feeding mechanism for pulling material through the sewing station of the machine. In one form, the feed mechanism includes upper and lower positively driven feed rollers which are continually biased into operable engagement with each other. Advantageously, the feed rollers are arranged such that a distance less than 0.8625 inches, measured in the direction of material advancement, separates the needle bar centerline from the centerline of the feed rollers whereby facilitating advancement of material through a sewing station on the machine and especially around four corners of a mattress being sewn.

Preferably, the mattress edge sewing machine further includes a drive system operably connected to the sewing machine drive shaft for positively driving each roller in timed relation relative to the reciprocal movements of the needle bar. In one form, the drive system for the feed rollers includes a series of intermeshing gears operably arranged between the drive shaft and the feed rollers of the feed mechanism.

In one embodiment, a throat plate forms part of the material supporting surface of the machine. Moreover, at least the lower feed roller preferably has a serrated peripheral edge for facilitating engagement and advancement of the materials being moved through the sewing station of the machine. In one form, the throat plate and the lower feed roller define cooperating instrumentalities for stripping material inadvertently grasped by the lower feed roller as the mattress material moves through the sewing station of the machine.

In one embodiment, a mechanism, mounted on the sewing machine frame, is provided for vertically and selectively moving the upper feed roller relative to the material supporting surface on the sewing machine. In a preferred embodiment, the mechanism for vertically and selectively moving the upper feed roller relative to the material supporting surface on the sewing machine is manually operated.

According to another aspect, there is provided a mattress edge chain-stitch sewing machine having a frame with a material supporting surface, a drive shaft revolubly mounted about a fixed axis in the frame, sewing instrumentalities defining a sewing station for the machine and including a reciprocally driven needle carried by a bar mounted in the frame and operable along a fixed centerline and an across-the-line of feed looper mounted in operable combination with the needle to form chain-stitches. The sewing machine further includes a feeding mechanism for advancing material beneath the needle bar in a generally horizontal direction. The feeding mechanism comprises a lower feed roller mounted for rotation about a fixed axis arranged below the material supporting surface of the machine and an upper feed roller. The upper feed roller is biased into operable engagement with the lower feed roller and is mounted for rotation about an axis in a manner permitting the upper feed roller to be vertically shifted relative to the lower feed roller. The upper feed roller is permitted to vertically move between a first position, wherein the upper and lower feed rollers are arranged in constant operable combination relative to each other to advance the material beneath the needle bar, and a second position. In the second position, the upper and lower feed rollers are separated from operable engagement relative to each other. The upper and lower feed rollers are arranged in the line of and rearwardly of the needle bar centerline by a distance less than 0.8625 inches, measured in the direction of material advancement, with the upper and lower feed rollers being positively and intermittently driven such that the material advancing beneath the needle bar is moved in timed relation relative to the reciprocation of the needle bar.

Preferably, a drive system is operably connected to the drive shaft and positively drives each feed roller in timed relation relative to reciprocal movements of the needle bar. The drive system includes a series of gears arranged in intermeshing relation relative to each other to effect positive movements of the feed rollers.

In one form, at least the lower feed roller has a serrated peripheral edge for facilitating engagement and advancement of the material moving through the sewing station. In another form, the upper and lower feed rollers each has a serrated peripheral edge for facilitating engagement and advancement of the material moving through said sewing station. In this regard, the sewing machine further includes structure for stripping material away from the periphery of either feed roller thereby enhancing material movement through the sewing machine.

In a preferred form, the mattress edge sewing machine further includes a mechanism for vertically and selectively moving the upper feed roller relative to the material supporting surface on the sewing machine. In one embodiment, the mechanism for vertically and selectively moving the upper feed roller relative to the material supporting surface on the sewing machine is manually operated.

According to another aspect, there is provided a mattress edge chain-stitch sewing machine including a frame, a needle bar mounted for generally vertical reciprocatory movements within the frame along a fixed axis, and a throat plate forming part of a material supporting surface of the machine. The throat plate defines a working edge for the machine and is disposed in laterally proximate relation from the fixed axis of the needle bar. A looper is mounted for movements laterally across the direction of feed of the machine. A tip of the looper remains to one lateral side of the working edge of the throat plate throughout its extent of travel. The needle bar moves in timed relation relative to the movements of the looper, and with the needle bar traversing a distance in a single vertical direction at a ratio greater than 3:1 relative to the distance in a single lateral direction traversed by the looper.

Preferably, the mattress edge sewing machine further includes a feed mechanism for pulling materials along a generally horizontal direction and beneath the needle bar. In one form, the feed mechanism includes a lower positively driven feed roller mounted on the frame for rotation about a fixed axis arranged below the material supporting surface of the machine and an upper feed roller. The upper feed roller is positively driven and is mounted on the frame for rotation about an axis arranged above the material supporting surface of the machine. In one embodiment, the upper and lower feed rollers are mounted on the sewing machine such that a distance ranging between about 0.4 inches and about 1.0 inch, measured in the direction of material advancement, separates the centerline of the upper and said lower feed rollers relative to the centerline of said the needle bar.

Preferably, the upper feed roller is mounted on the machine in a manner permitting the upper feed roller to be shifted relative to the lower feed roller between first and second positions. In the first position, the upper and lower feed rollers are arranged in operable combination relative to each other to pull materials along a generally horizontal direction beneath said needle bar. In the second position, the upper and lower feed rollers are separated from operable engagement relative to each other.

According to yet another aspect, there is provided a mattress edge chain-stitch sewing machine having a frame, a drive shaft revolubly mounted in the frame, a needle bar driven by the shaft and reciprocal along a fixed path of travel, and a throat plate arranged beneath the needle bar and forming part of a material supporting surface for the machine. An edge of the throat plate is disposed in proximate lateral relation to the needle bar and defines a working edge for the machine. The sewing machine further has a stitch forming mechanism including stitch forming instrumentalities including a needle mounted to a lower end of the needle bar for movement along a fixed generally vertical reciprocal path of travel, and a looper. The looper is arranged for generally elliptical and across-the-line of feed movements relative to and in combination with the needle to form chain-stitches in a workpiece. During a sewing operation, a tip of the looper remains to one lateral side of the working edge of the sewing machine. During a sewing operation, the needle traverses a distance in a single vertical direction at a ratio greater than 3:1 relative to the distance in a single lateral direction traversed by said looper.

Primarily because of the thickness of material moving through sewing station, the mattress edge sewing machine preferably includes a needle guard. In a preferred form, the needle guard is driven in timed relation relative to the movement of the needle during the stitch forming cycle of the sewing machine.

In view of the above, one object of this invention is to provide a mattress edge chain-stitch sewing machine having a feed mechanism comprised of a pair of feed rollers arranged on the machine such that the axis about which each feed roller rotates is disposed in proximate to the needle thereby enhancing advancement of the material being sewn through a sewing station of the machine especially as the machine moves about the four corners on the mattress.

Another object of the present invention is to provide a mattress edge chain stitch sewing machine having a pair of intermittently driven feed rollers arranged on the machine such that the axis about which each feed roller rotates is disposed proximate to the needle and which are positively driven only when the needle is out of the material being sewn.

Still another feature of this invention relates to the provision of a mattress edge chain stitch sewing machine including a thread carrying needle, which moves along a vertical reciprocatory path which is fixed relative to a frame of the machine, and a looper which moves across the line of feed to cooperate with the needle to form chain-stitches, and wherein, in one vertical direction of travel, the needle travels a distance equal to at least twice the lateral distance traveled by the looper in a single stitch forming cycle so as to increase the material handling capacity of the machine.

Still another feature of this invention relates to providing a mattress edge chain-stitch sewing having stitch forming instrumentalities including a needle movable along a fixed generally vertical reciprocal path of travel, and an across-the-line of feed looper, with a tip of the looper remaining to one lateral side of a working edge of a throat plate on the machine, and with the needle traversing a distance in a single vertical direction at a ratio greater than 3:1 relative to the distance in a single lateral direction traversed by the looper so as to enhance the sewing capacity of the machine.

These and additional features, objects and advantages of the present invention will become more readily apparent from the drawings and the following description of the invention.

DESCRIPTION OF THE DRAWINGS

FIG. 7 is top left side perspective view of one form of mechanism for operating a needle guard in timed relation relative to the needle of the mattress edge sewing machine;

FIG. 8 is an enlarged front view, with parts broken away, to show a portion of a feed mechanism arranged in operable combination with the mattress edge sewing machine;

FIG. 14 is a top left perspective view of one form of throat plate used in combination with the mattress edge sewing machine shown in the drawings;

FIG. 15 is an enlarged top plan view of a feed roller area of the throat plate illustrated in FIG. 14; and FIG. 16 is a sectional view taken along line 16-16 of FIG. 15.

DETAILED DESCRIPTION OF THE INVENTION

Figure 1:
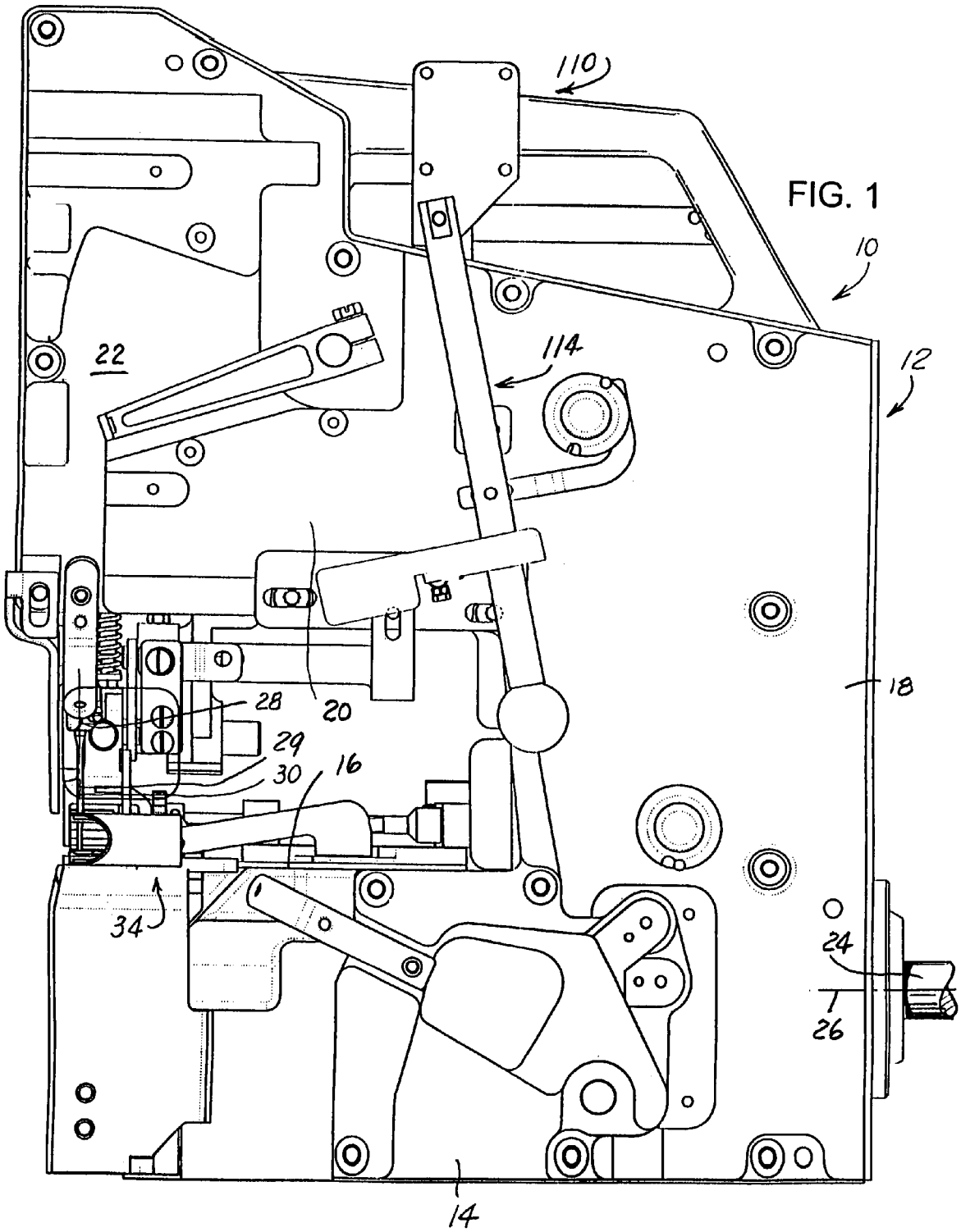
FIG. 1 is a front view of a mattress edge sewing machine embodying principals of the present invention.

While the present invention is susceptible of embodiment in multiple forms, there is shown in the drawings and will hereinafter be described a preferred embodiment of the invention, with the understanding the present disclosure sets forth an exemplification of the invention which are not intended to limit the invention to the specific embodiment illustrated and described.

Referring now to the drawings, wherein like reference numerals indicate like parts throughout the several views, there is schematically shown in FIG. 1 a mattress edge chain-stitch sewing machine, generally identified by reference numeral 10. Sewing machine 10 includes a housing 12 having base portion or bed 14 provided with a work or material supporting surface 16 including a throat plate 17 (FIG. 2), a standard 18 extending vertically from one end of bed 14, and an arm 20 which overlies bed 14 and terminates in a sewing head portion 22. A drive shaft 24 axially extends from and is supported in the bed 14 for rotation about a fixed axis 26. A free end of shaft 24 is operably connected in a conventional fashion to a suitable power source (not shown).

Figure 2:
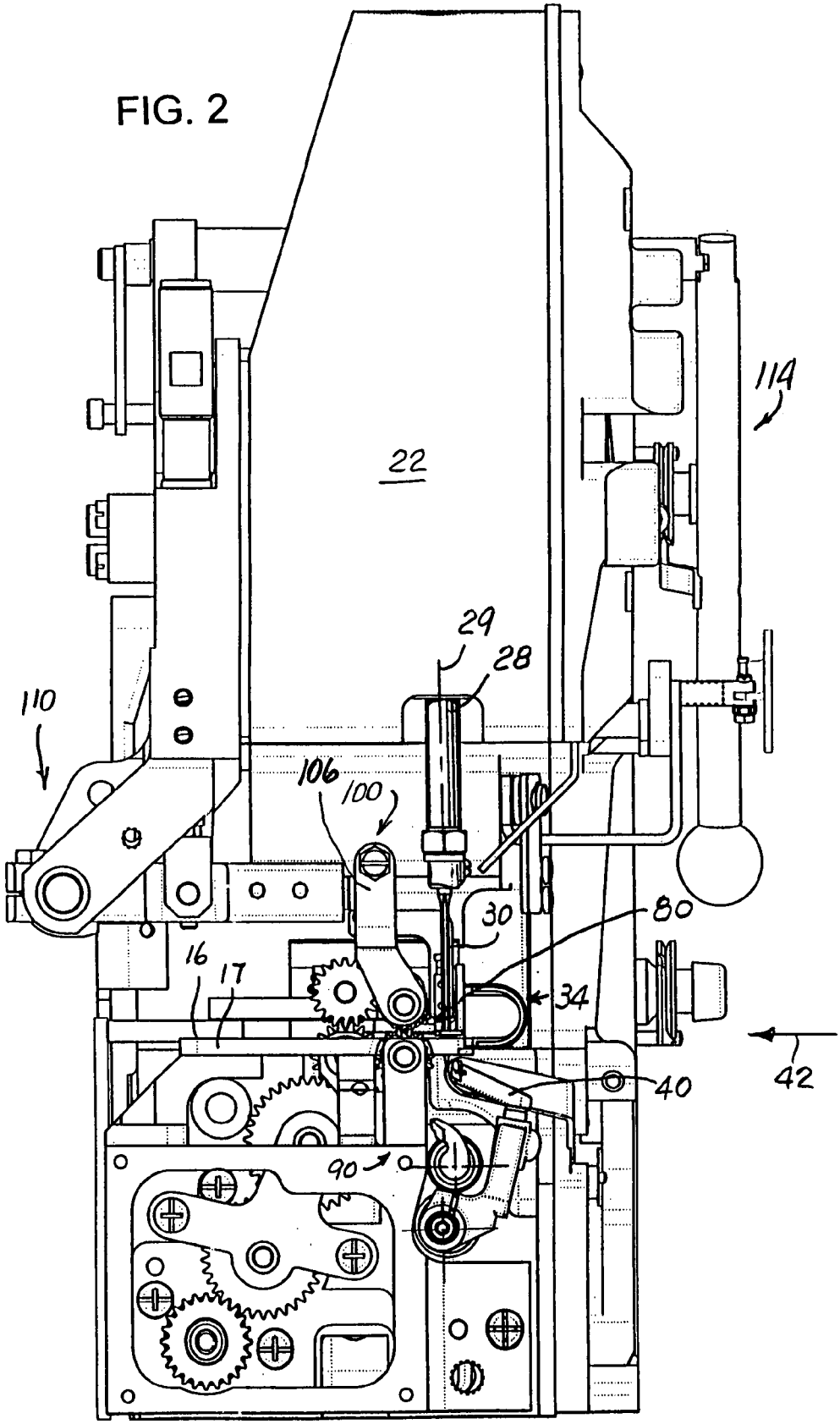
FIG. 2 is an end view of the mattress edge sewing machine illustrated in FIG. 1 with parts removed to show internal details.

A needle bar 28 is mounted within the sewing head portion 22 of machine 10. The needle bar 28 is operably connected to and driven by shaft 24 in a well known conventional fashion. Notably, and as shown in FIGS. 1 and 2, the needle bar 28 is mounted for vertically movement along a fixed centerline 29. In the embodiment illustrated, the needle bar 28 carries, at a lower end thereof, a thread carrying needle 30 forming part of stitch forming instrumentalities of and defining a stitch forming area or sewing station for the machine 10.

As shown in FIGS. 1 and 2, sewing machine 10 can further include a suitable and conventional apparatus 34 for guiding a suitable tape or other strip into the stitch forming area of machine 10. During a sewing cycle, and as well known in the art, a tape or strip is guided by apparatus 34 and extends over the exterior of the mattress edges being sewn by machine 10 to provide an enhanced aesthetic exterior appearance to the mattress edge.

Figure 3:
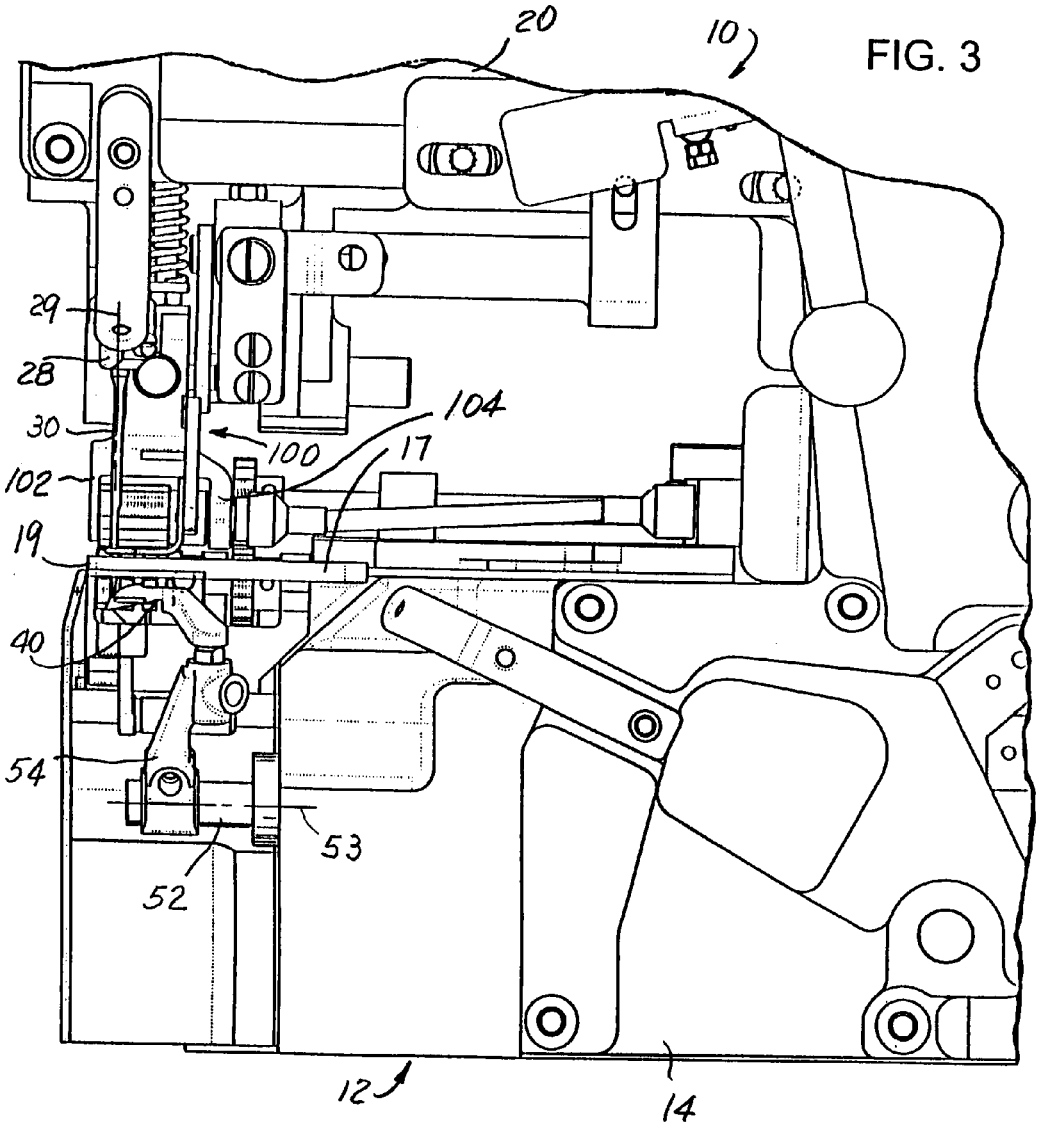
FIG. 3 is a fragmentary enlarged front view of the mattress edge sewing machine shown in FIG. 1 with parts removed to show internal details.
Figure 4:
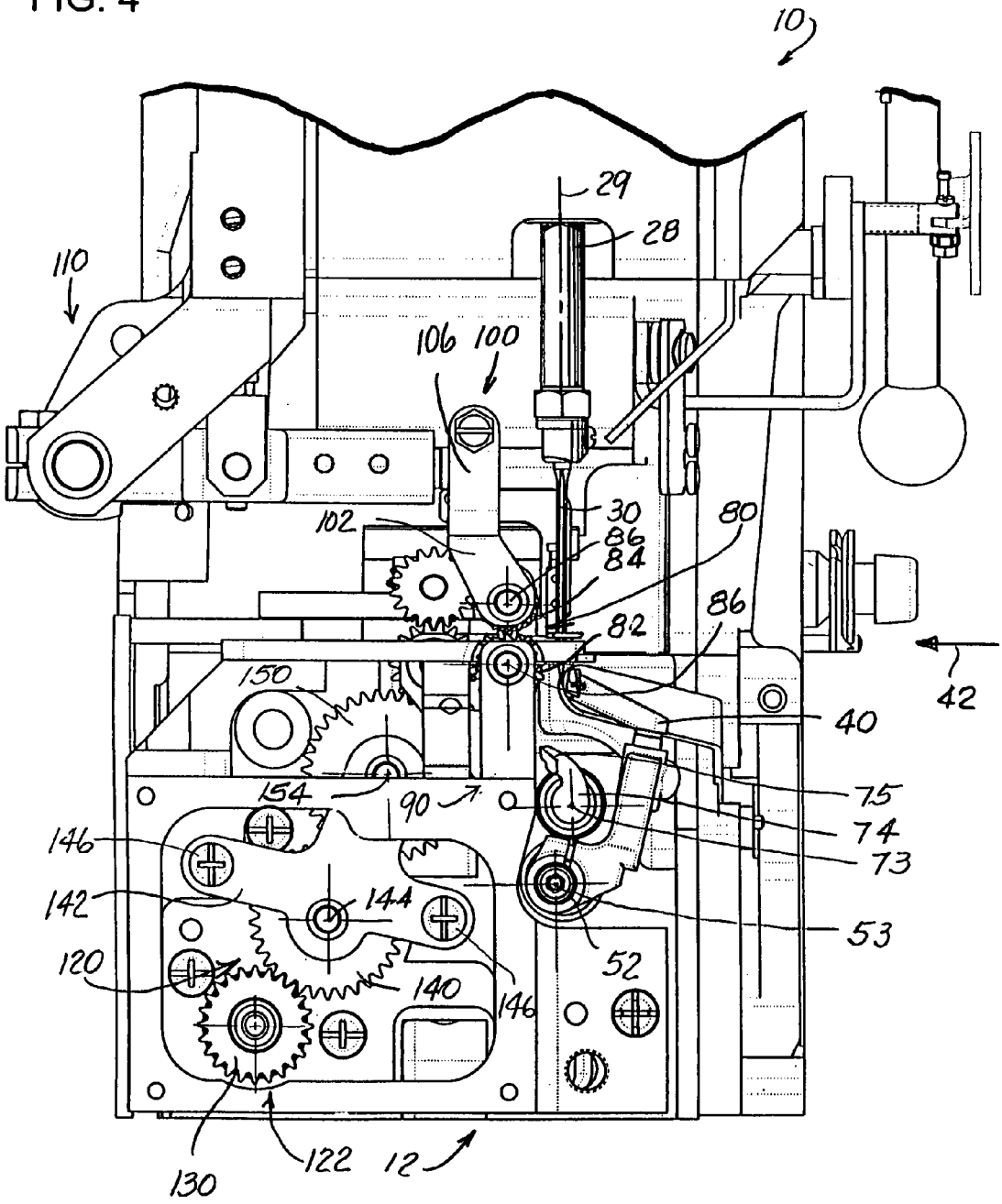
FIG. 4 is a an enlarged fragmentary end view similar to FIG. 2.

As shown in FIGS. 2, 3 and 4, machine 10 is further provided with a thread carrying looper 40. The thread carrying looper 40 is adapted for cooperation with the needle 30 to conventionally form chain-stitches in a workpiece or material being advanced in the direction of arrow 42 (FIGS. 2 and 4) through the sewing station of the machine 10. In the embodiment illustrated, looper 40 is driven is a generally elliptical path extending across the direction of movement of the material moving through the sewing area of the machine to form a Federal Stitch Type 401 stitch. Such looper movement is commonly referred to as an "across the line of feed" type of looper movement. While illustrated with a looper 40 which moves across the line of feed, it should be appreciated certain aspects of the present invention apply equally to either across the line of feed sewing machines and/or in-line of feed sewing machines.

Figure 5:
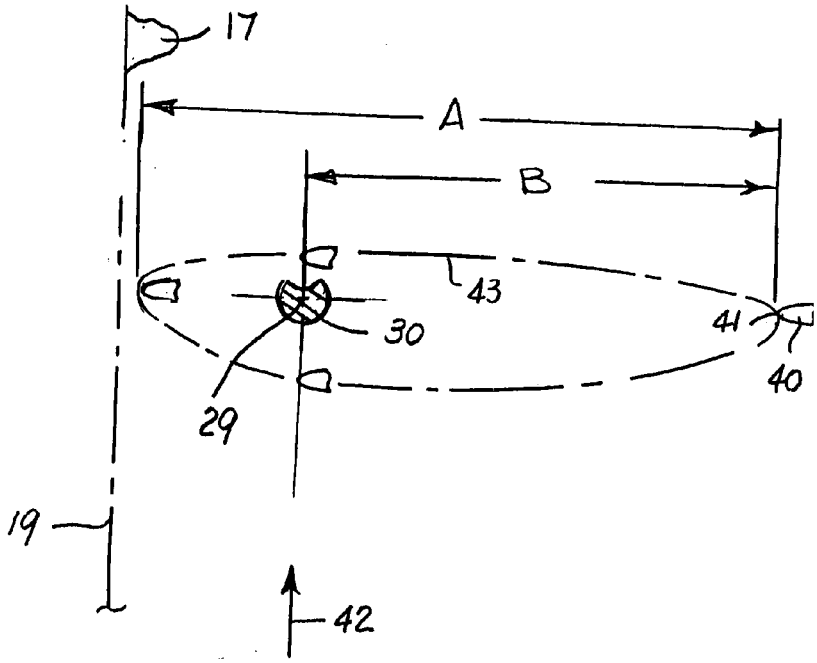
FIG. 5 is a top plan view schematically illustrating a lateral path of travel traversed by a tip of a looper forming part of the machine illustrated in FIG. 1.

In FIG. 5, dash line 43 illustrates a schematically enlarged path of movement of the tip 41 of the looper 40 during a sewing cycle. As shown, the path of movement of the looper tip 41 during a sewing cycle is elongated in a direction extending generally normal or across the direction of material movement (as shown by arrow 42) passing through the sewing station of the machine. As schematically represented in FIG. 5, looper 40 is driven during a sewing cycle such that the looper tip 41 simultaneously partakes of an elongated lateral movement and a fore-and-aft rocking motion. As shown in FIG. 5, the looper 40 moves in a counterclockwise direction. In the form shown, looper 40 laterally moves endwise to seize and shed needle thread loops and also includes an alternating fore-and-aft motion to avoid the needle 30 alternatively on opposite sides thereof for sewing chain-stitches (Federal Stitch Type 401).

As shown in FIG. 3 and schematically represented in FIG. 5, throat plate 17 defines a working edge 19 for the sewing machine 10 extending generally parallel to the direction of feed of material (as represented by arrow 42) moving through the machine. As mentioned above, and to aid in controlling the material moving through the sewing station of the machine 10, the working edge 19 of throat plate 17 is disposed laterally proximate to the centerline 29 of the needle bar 28. In the illustrated embodiment, and because the tip 41 of looper 40 cannot laterally extend beyond the working edge 19 of the machine 10 during a sewing cycle, lateral movements of the looper 40 are not equally disposed to opposed sides of the needle bar centerline 29. As shown in FIG. 5, the looper tip 41 moves a total distance A which, in the illustrated embodiment, is equal to about 0.406 inches in a single lateral direction. In the illustrated embodiment, and during a sewing cycle, because the looper tip 41 cannot extend beyond the working edge 19 of the sewing machine, looper 40 laterally moves or travels a distance B equal to about three times greater lateral distance to one side of the needle bar 29 than the other.

Preferably, and to permit machine 10 to sew mattress panels and related materials having a cumulative thickness ranging between about 0.187 inches and about 0.562 inches, the needle bar 28 and, thus, needle 30 traverse or travel a distance which, in a single vertical direction, significantly exceeds the distance traversed or traveled by the looper in a single lateral direction. In a preferred form, and during a sewing cycle, the needle 30 traverses a distance in a single vertical direction greater than two to three times the lateral distance traversed by the looper 40 in a single lateral direction. In the embodiment illustrated, and during a sewing cycle, looper 40 travels or traverses a distance A, in a single lateral direction, which is about equal to 0.406 inches. So as to add significant versatility thereto, and in contrast to accepted sewing techniques, machine 10 is preferably configured such that the needle bar 28 and, thus, needle 30 traverse a distance of about 2.359 inches in a single vertical direction during a sewing cycle.

To drive the looper 40 both laterally and in a fore-and-aft or rocking motions whereby imparting the requisite and generally elliptical-like movements to the looper 40 in timed relation relative to reciprocation of the needle 30 (FIG. 4), a looper drive mechanism 50 (FIG. 6) is provided. The looper drive mechanism 50 can take a myriad of different designs and shapes without departing or detracting from the principals of the present invention. In the embodiment shown in FIG. 6, the looper drive mechanism 50 includes an elongated looper supporting shaft 52 defining an axis 53. In the illustrated embodiment, the looper supporting shaft 52 is journalled in the bed portion 14 of the machine 10 for both axial and rocking movements along and about axis 53. Preferably, axis 53 of the looper supporting shaft 52 extends generally parallel to the main drive shaft 24 of machine 10. As shown in FIG. 3, one end of shaft 52 extends beyond housing 12 and has the looper 40 suitably connected thereto as by a suitably shaped support bracket 54. The axial shifting movements and rocking movements of the looper supporting shaft 52 effectively drive looper 40 in an elliptical path which, as discussed above, extends across the feeding direction of sewn material (as indicated by arrow 42) moving through machine.

Figure 6:
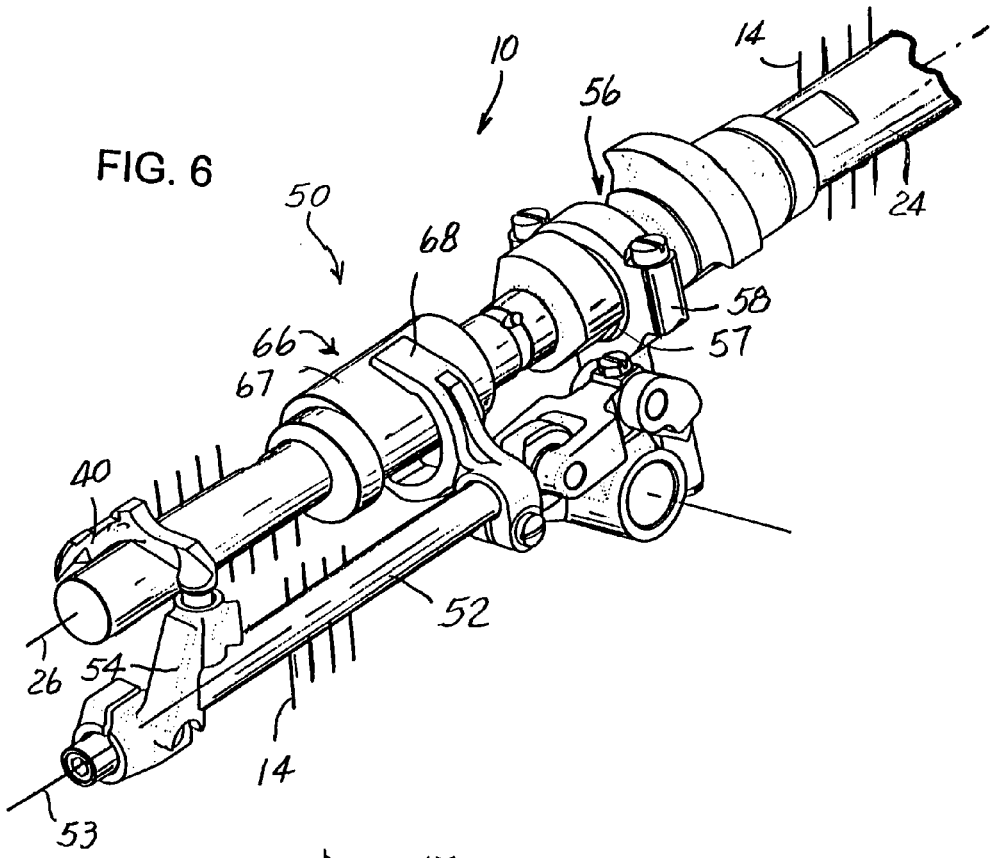
FIG. 6 is a top left side perspective view of one form of mechanism for imparting elliptical movements to the looper of the mattress edge sewing machine.

In the embodiment shown in FIG. 6, looper drive mechanism 50 further includes a first actuator 56 operably connected to the looper supporting shaft 52 for imparting predetermined lateral movements to shaft 52. As shown in FIG. 6, the first actuator 56 includes an eccentric 57 mounted on and rotatable with the main drive shaft 24 of the machine 10. The eccentric 57 is arranged in operable combination with a follower 58 operably coupled to the looper supporting shaft 52 and which converts the rotational movement of the eccentric 57 into lateral movements of shaft 52 thereby driving the looper 40 in both lateral directions during a sewing cycle.

In the embodiment shown in FIG. 6, looper drive mechanism 50 further includes a second actuator 66 operably connected to the looper supporting shaft 52 for imparting looper avoid movements to shaft 52. As shown in FIG. 6, the second actuator 66 includes an elongated eccentric 67 mounted on and rotatable with the main drive shaft 24 of the machine 10. Eccentric 67 is arranged in operable combination with a follower 68 operably coupled to the looper supporting shaft 52 and which converts the rotational movement of the eccentric 60 into rocking or pivotal movements of shaft 52 about axis 53 thereby providing the requisite avoid movements of the looper 40 during a sewing cycle.

In a preferred embodiment, sewing machine 10 is furthermore provided with a driven needle guard mechanism 70 operable in timed relation relative to movements of the needle 30. Needle guard mechanism 70 can take a myriad of different designs and shapes without departing or detracting from the principals of the present invention. In the embodiment shown in FIG. 7, the needle guard mechanism 70 includes an elongated shaft 72 defining an axis 73. In the illustrated embodiment, shaft 72 is journalled in the bed portion 14 of the machine 10 for rocking movements about axis 73. Preferably, axis 73 extends generally parallel to the main drive shaft 24 of machine 10. One end of shaft 72 extending beyond housing 12 has a guard 74 suitably connected thereto and radially projecting therefrom. A free end of the guard 74 defines a camming surface 75 for engaging and operably positioning a lengthwise portion of the needle 30 (FIG. 4) disposed beneath the throat plate 17 (FIG. 4) for operable combination with the looper 40 during a sewing cycle.

In embodiment illustrated in FIG. 7, mechanism 70 further includes an actuator 76 operably connected to shaft 72 for imparting predetermined movements to guard 74. As shown in FIG. 7, actuator 76 preferably includes an eccentric 77 mounted on and rotatable with the main drive shaft 24 of machine 10. The eccentric 77 is arranged in operable combination with a follower 78 operably coupled to shaft 72 and which converts the rotational movement of the eccentric 77 into rocking movements of shaft 72 about axis 73 thereby positioning the guard 74 and camming surface 75 in timed relation relative to reciprocation of the needle 30.

Because machine 10 is provided with an internal lubrication system (not shown), concerns over friction and heat build-up between the looper drive shaft 52, the bed portion 14 of machine 10, the eccentrics 56 and 66 and their respective followers 58 and 68, along with the needle guard shaft 72, the bed or base portion 14 of machine 10, along with the eccentric 76 and its follower 78 are substantially eliminated.

Figure 11:
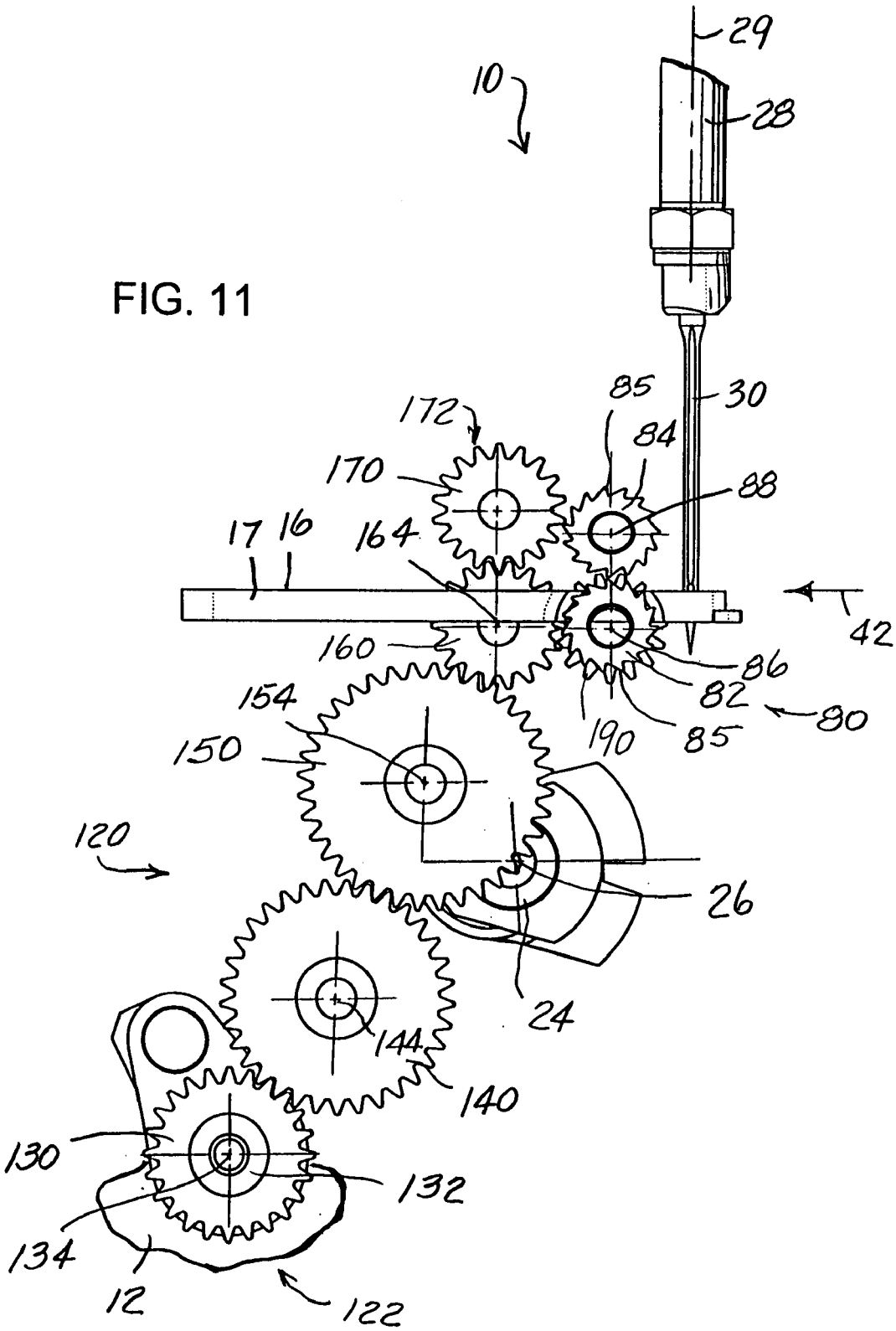
FIG. 11 is an enlarged end view, with parts broken away to show details, of a power train forming part of the feed mechanism illustrated in FIG. 10.

Because machine 10 must be capable of advancing materials having a cumulative thickness of up to about 0.562 inches through the sewing area, machine 10 is further provided with a feeding mechanism 80. In the preferred embodiment illustrated in FIG. 4, feeding mechanism 80 includes a pair of driven feed rollers 82 and 84 preferably arranged in general vertical alignment relative to each other. In a preferred form, the feed rollers 82, 84 are resiliently biased into engagement with each other. During a sewing operation, the feed rollers 82, 84 are in continuous operative engagement with opposed sides of the material moving through the sewing station of machine 10. As shown in FIGS. 4 and 11, the lower roller 82 rotates about a generally horizontal axis 86 while the upper roller 84 rotates about a generally horizontal axis 88 which generally parallels axis 86. Preferably, each roller 82, 84 has an outer edge 85 (FIG. 11) configured to facilitate gripping engagement with the material passing therebetween. Preferably, the outer edge 85 of each feed roller has a serrated configuration to facilitate gripping engagement with the material passing therebetween.

In one form, and in the direction of material feed (as indicated by arrow 42), the axes 86 and 88 for the feed rollers 82 and 84, respectively, are disposed less than one inch (1.0 inch) directly downstream or rearwardly of the fixed axis 29 of the needle bar 28. In a preferred form, and considering the direction of material feed (as indicated by arrow 42), the axes 86 and 88 for the feed rollers 82 and 84, respectively, are spaced directly downstream or rearwardly of the fixed reciprocal axis 29 of the needle bar 28 by a distance ranging between about 0.4 inches and about 1.0 inch. In a most preferred embodiment, and considering the direction of material feed (as indicated by arrow 42), the axes 86 and 88 for the feed rollers 82 and 84, respectively, are spaced directly downstream or rearwardly of the fixed reciprocal axis 29 of the needle bar 28 by a distance of about 0.5 inches.

In the embodiment shown in FIGS. 2, 4 and 8, the lower feed roller 82 is rotatably mounted and is primarily disposed to an underside of the work supporting surface 16 of machine 10 by a lower roller support 90 suitably secured to the base or bed portion 14 of housing 12. In the embodiment shown in FIG. 8, and when mounted to the machine 10, a portion of the peripheral edge of the lower feed roller 82 projects or extends above the work supporting surface 16 of machine 10. In the embodiment exemplified in FIG. 8, a pair of rigid and laterally spaced upstanding arm portions 92 and 94 on the lower roller support 90 serve to maintain the rotational axis 86 of roller 82 vertically fixed relative to the throat plate 17

Returning to FIGS. 2 and 4, the upper roller 84 of feeding mechanism 80 is mounted by a movable upper roller support 100. In one form, the upper roller support 100 includes a pair of spaced arm portions 102 and 104 (FIGS. 3 and 4) which rigidly depend from and are commonly joined to an upstanding mounting portion 106 of the upper roller support 100. Toward their free ends, the depending arm portions 102, 104 of the upper roller support 100 embrace and mount the upper feed roller 84 therebetween for rotation about fixed axis 86. For purposes discussed hereinbelow, the upper feed roller 84 is preferably provided with an extension 87 (FIG. 9) axially extending beyond the depending arm portion 104 of the upper feed roller support 100 and toward the vertical standard 18 of the machine 10. As shown in FIG. 4, and toward an upper end, the mounting portion 106 of the upper roller support 100 is carried and movably influenced by a resiliently biased mechanism 110 secured to housing 12.

Figure 9:
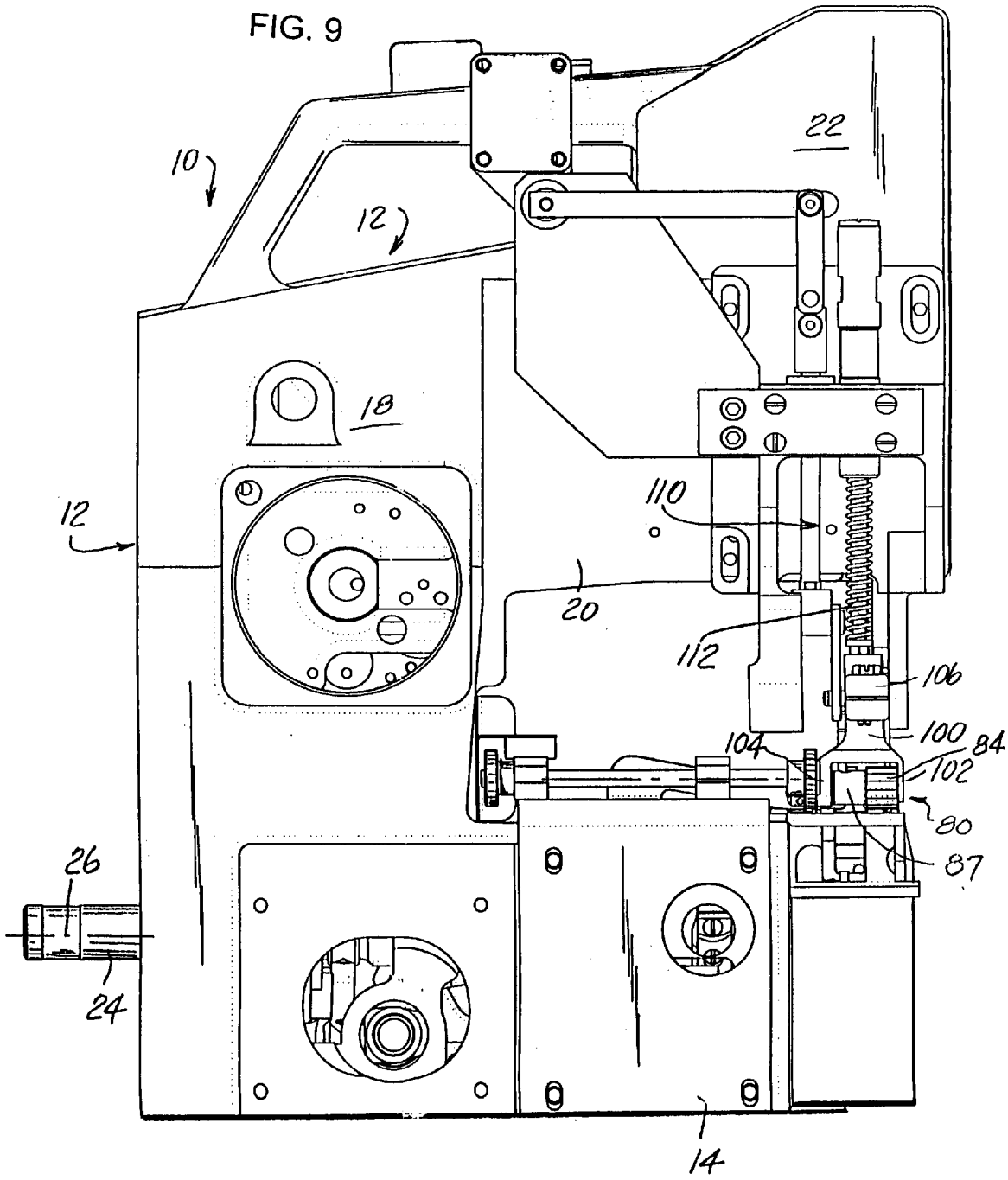
FIG. 9 is a rear view of the mattress edge sewing machine shown in FIG. 1.

As shown in FIG. 9, mechanism 110 includes a spring 112 for continually urging the upper roller support 100, carrying the intermittently driven upper roller 84, into biased engagement with the lower roller 82 of feed mechanism 80. In the embodiment shown in FIGS. 1 and 2, mechanism 110 further includes a selectively operated apparatus 114 for vertically raising the upper roller support 100 and thereby lifting or raising the upper feed roller 84 out of engagement with the lower feed roller 82. In a preferred embodiment, apparatus 114 is configured to releasably maintain the upper feed roller 84 out of operable engagement with the lower feed roller 82 until mechanism 110 is purposefully conditioned such that feed roller 84 is returned into biased engagement with feed roller 82 under the influence of spring 112. In the illustrated form, apparatus 114 is manually operated. It will be appreciated, however, apparatus could also be selectively operated by a suitable driver or solenoid without departing or detracting from the spirit and scope of the invention.

As mentioned, the needle bar 28 (FIG. 1) of machine 10 reciprocally moves along a fixed axis 29. Accordingly, if the material being sewn advance or is move in the direction of arrow 42 (FIG. 4) while any lengthwise portion of the needle 30 remains in the material, the likelihood of damage to the needle 30, the needle bar 28, and the machine 30 is significantly enhanced.

In this regard, feeding mechanism 80 is preferably designed to move the material through the sewing station and past the needle 30 in an intermittent fashion. Suffice it to say, the. intermittently operated feeding mechanism 80 is operated in timed sequence with the needle bar 28. That is, during a sewing operation, the feed rollers 82, 84 of feeding mechanism 80 are operated only while the needle 30 remains out of or disengaged from the material being advanced through the sewing station of machine 10. In one form, the lower and upper feed rollers 82 and 84, respectively, are operational for only about 35% to about 50% of the time the needle bar 28 makes one complete up and down reciprocal movement. The remainder of the time, i.e., as long as the needle 30 remains in the material, the lower and upper feed rollers 82 and 84, respectively, of mechanism 80 do not rotate and are not effective to advance or move the material through the sewing station of machine 10.

To accomplish these desired ends, and in a preferred form, feeding mechanism 80 is designed and configured with a drive system 120 (FIG. 10) for intermittently and concomitantly driving the lower and upper feed rollers 82 and 84, respectively, of mechanism 80 only while the needle 30 remains out of or disengaged from the material being advanced through the sewing station of machine 10. The drive system 120 can take a myriad of different designs and shapes without departing or detracting from the principals of the present invention. In the embodiment shown by way of example in FIGS. 4, 10 and 11, drive system 120 includes a positively driven power train 122 for transferring rotation from the main drive shaft 24 (FIG. 11) of machine 10 intermittently to each feed roller 82, 84 of mechanism 80.

Figure 10:
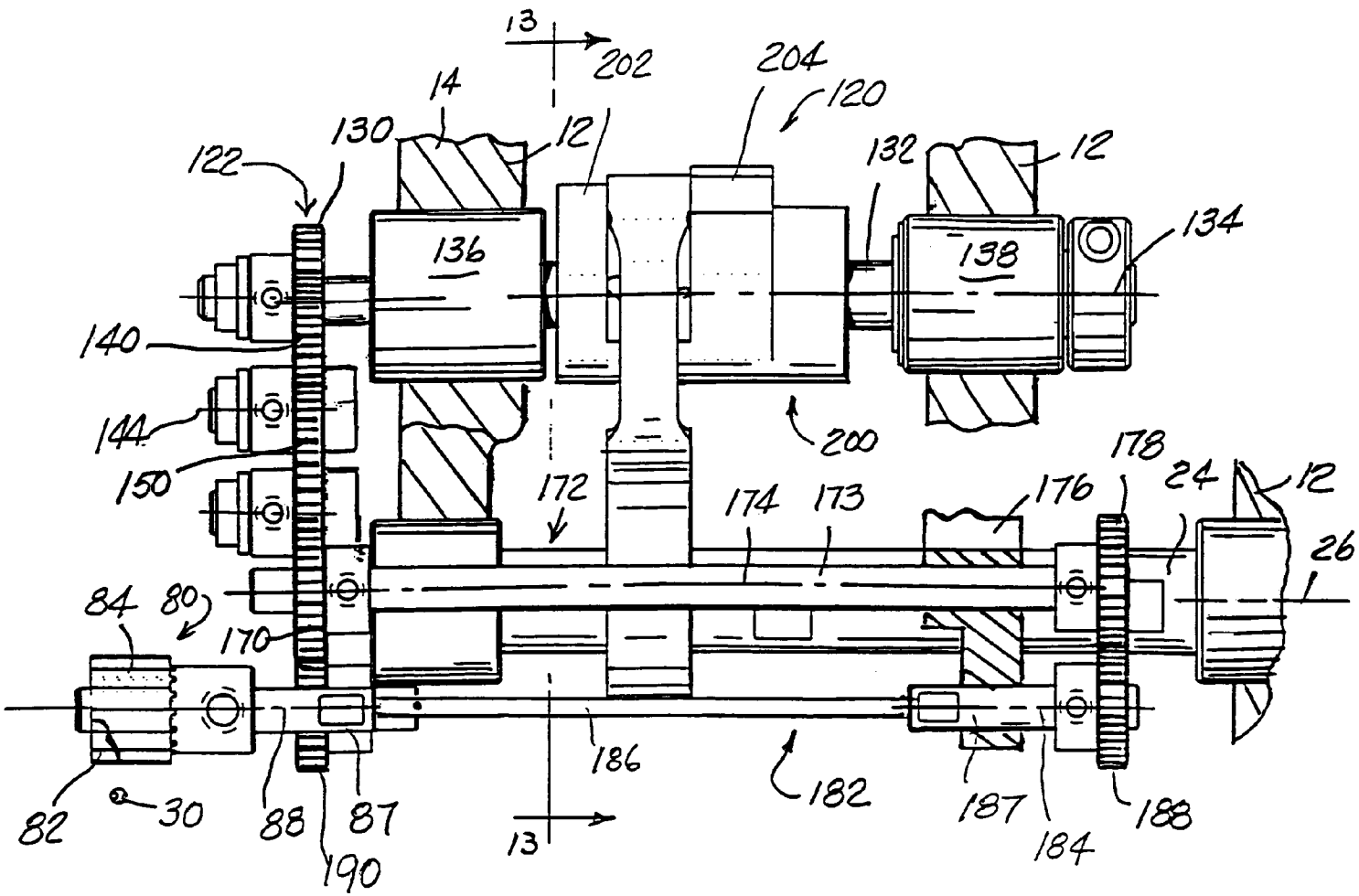
FIG. 10 is a fragmentary top plan view, with parts broken away to show details, of one form of feed mechanism for moving material through the mattress edge sewing machine.

In the embodiment illustrated in FIGS. 10 and 11, power train 122 includes a series of intermeshing gears operably arranged between the drive shaft 24 and the feed rollers 82, 84. As shown, an input drive gear 130 is mounted for rotation or rotary movement with an elongated shaft 132, to which gear 130 is non-rotatably secured. Shaft 132 defines an axis 134 which is fixed relative to housing 12 and generally parallels the fixed axis 26 about which the main drive shaft 24 is drivingly rotated. As schematically illustrated in FIG. 10, the elongated shaft 132 can be journalled by a pair of spaced bearings or bushings 136 and 138 provided within the bed portion 14 of housing 10.

Input drive gear 130 is in intermeshing engagement with gear 140. As shown in FIG. 4, gear 140 is supported for rotational movement on an inverted and generally T-shaped support bracket 142. As shown in FIGS. 4 and 11, gear 140 is mounted for rotary movement about an axis 144 extending generally parallel to axis 134 of shaft 132 about which the input gear 130 rotates when driven. As illustrated in FIG. 4, two opposed ends of the support bracket 142 are fixedly secured, as with fasteners 146 or the like, to the base or bed portion 14 of the sewing machine housing 10 whereby providing stiffness to the support bracket 142.

Gear 140 is also arranged in intermeshing engagement with gear 150. As shown, gear 150 is supported for rotation toward another free end of support bracket 142. As shown in FIGS. 4 and 11, gear 150 is supported for rotational movement about an axis 154 extending generally parallel to axis 144 about which gear 140 rotates when driven by the input drive gear 130.

As shown in FIG. 11, gear 150 is also arranged in intermeshing relation with a gear 160. In one form, gear 160 is supported for rotation by the lower looper support 90 (FIG. 4). Suffice it to say, gear 160 is supported for rotation or movement about an axis 164 extending generally parallel to axis 154 about which gear 150 rotates when power is inputted to the drive system 120 through input drive gear 130.

Figure 12:
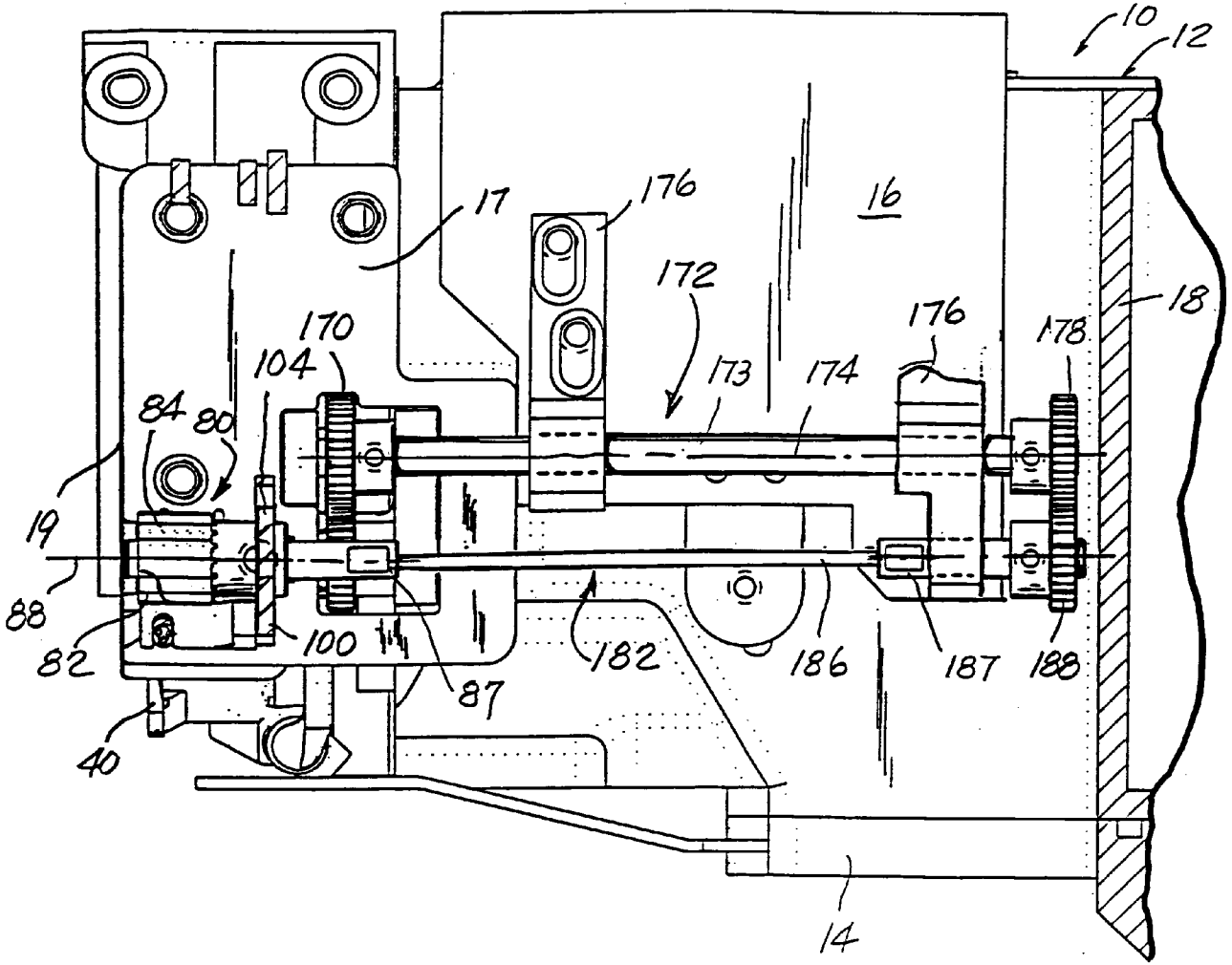
FIG. 12 is a fragmentary top plan view, with parts broken away to show details, of the feed mechanism for moving material through the mattress edge sewing machine.

In the form shown in FIGS. 10 through 12, the power train 122 for transferring intermittent movement to the feed rollers 82, 84 of mechanism 80 can further include a gear 170 arranged in intermeshing relation with gear 160. As shown, gear 170 forms part of a rotatable shaft assembly 172 including an elongated shaft 173 with gear 170 secured toward one end of and for rotation with shaft 173. As shown, shaft assembly 172 defines an axis 174 extending generally parallel to axis 164 about which gear 160 rotates when power is inputted to the drive system 120 through input drive gear 130. In the embodiment illustrated in FIG. 12, shaft assembly 172 is supported above the work supporting surface 16 of machine 10 by one or more suitable support brackets 176 preferably secured to the work supporting surface 16 of machine 10. In the exemplary embodiment, shaft assembly 172 further includes another gear 178 fixed to the end of shaft 173 opposite from gear 170. As will be appreciated from an understanding of shaft assembly 172, and as a result of the intermeshing relationship between gears 130, 140, 150, 160 and 170 of power train 122, gear 178 of assembly 172 rotates about axis 174 in response to rotational movement being imparted to the input drive gear 130 of the drive system 120.

In the embodiment of the power train 122 shown in FIGS. 10 and 12, gear 178 of shaft assembly 172 is arranged in intermeshing relation with gear 188 forming part of a flexible shaft assembly 182 arranged proximate to shaft assembly 172 and which is likewise supported above the work supporting surface 16 of machine 10. In the embodiment shown in FIG. 12, the support bracket 176 disposed proximate to gear 178 supports both shaft assembly 172 and an axial extension 187 provided on gear 188. In the exemplary embodiment, gear 188 is supported for rotation about an axis 184 extending generally parallel to the axis 174 of shaft 172 and which is generally aligned in a fore- and aft direction with the axis 86 of the upper feed roller 84 of roller drive mechanism 80.

Shaft assembly 182 of power train 120 transmits intermittent driving movements to the upper feed roller 84 of feed mechanism 80 in response to rotary drive movements being imparted to the input gear 130 of the drive system 120. In the embodiment illustrated in FIGS. 10 and 11, shaft assembly 182 has a flexible design to allow for and accommodate vertical displacement of the upper feed roller 84 of feed mechanism 80 in response to conditioning of apparatus 114 while maintaining a positive drive connection between the input drive gear 130 of power train assembly 122 and the upper feed roller 84 of feed mechanism 80.

In the embodiment illustrated in FIG. 12, shaft assembly 182 further includes an elongate and flexible connector 186 operably connected to and axially extending from a free end of the axial extension 187 of gear 188. An opposite end of the flexible connector 186 is operably connected to the axial extension 87 of the upper feed roller 84. As will be appreciated, the flexible connector 186 of shaft assembly 182 readily allows for selective vertical manipulation and movement of the upper feed roller 84 under the influence of apparatus 114.

Returning to FIG. 11, and in addition to providing input drive movements to shaft assembly 172 and, ultimately, to the upper feed roller 84 of mechanism 80, gear 160 of the drive system 120 also serves to positively drive and transmit rotary movements to gear 190 arranged in intermeshing relation with gear 160. In one form, gear 190 is supported for rotary movement by the support 90 (FIGS. 4 and 8). Preferably, gear 190 is mounted to rotate with and drive an axial extension 89 (FIG. 8) provided on the lower feed roller 82. As such, when rotation is imparted to input drive gear 130, such rotary movements are positively transmitted through the power train 122 to the lower feed roller 82. The relationship between the intermeshing gears of drive train 122 is such that the lower and upper feed rollers 82 and 84, respectively, of the drive mechanism 80 are preferably driven in synchronous relation relative to each other.

In one form, gear 160 is supported for rotation by the support 90 (FIG. 4). Suffice it to say, gear 160 is supported for rotation about an axis 164 extending generally parallel to axis 154 about which gear 150 rotates when power is inputted to the drive system 120 through input drive gear 130.

Figure 13:
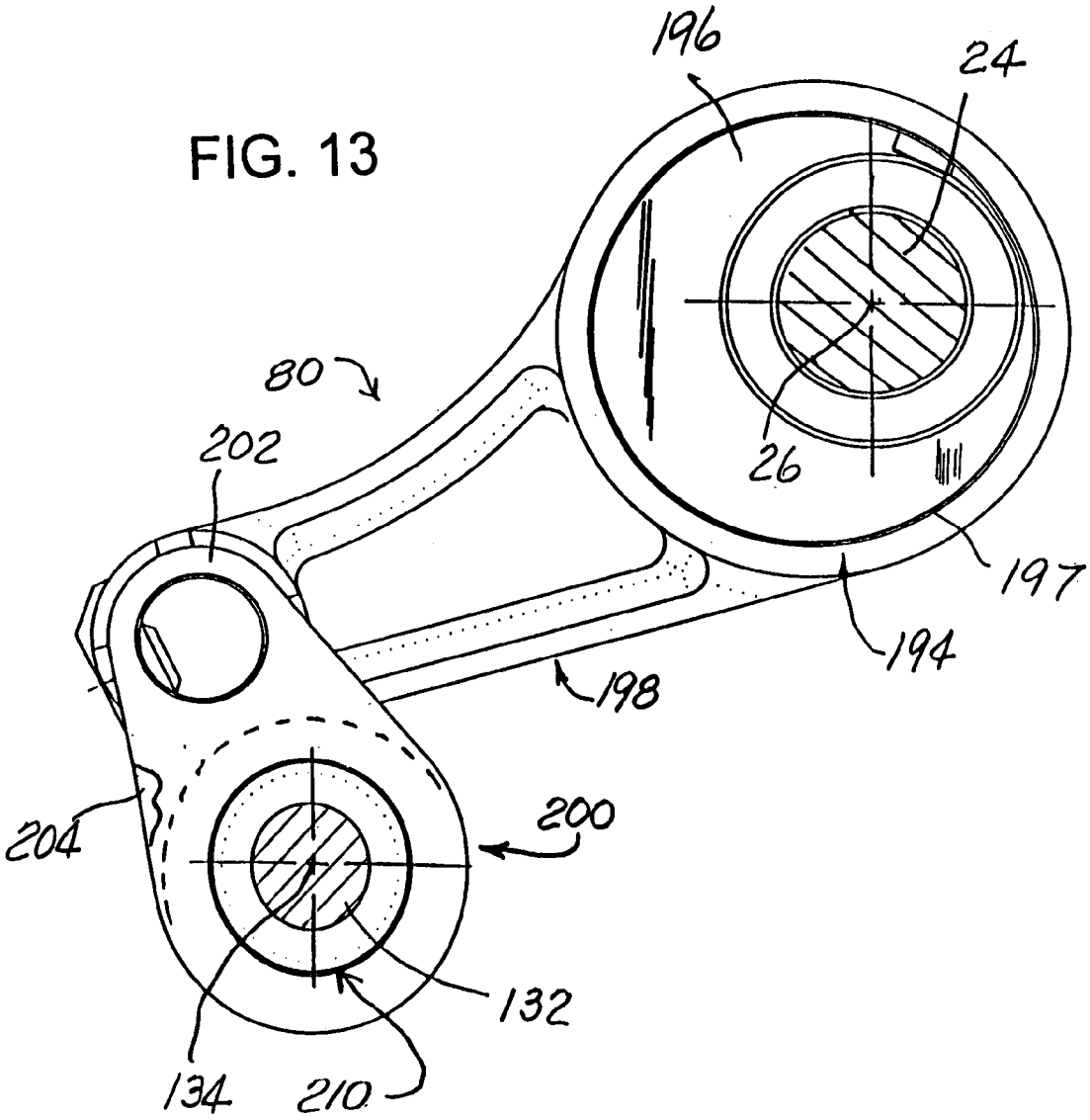
FIG. 13 is an enlarged sectional view taken along line 13-13 of FIG. 10.

To impart an intermittent driving action to the feed rollers 82, 84 of feeding mechanism 80 in timed sequence or relation relative to the endwise movements of the needle bar 28, and as shown in FIG. 13, an actuator 194 is provided as part of feeding mechanism 80. In a preferred form, actuator 194 includes an eccentric 196 operably secured to and rotatable with the main drive shaft 24 of machine 10. That is, and as shown in FIG. 13, an outer peripheral edge 197 of actuator 194 is arranged in eccentric relation relative to the axis 26 of rotation of the main drive shaft 24. Arranged in operable combination with and reciprocally driven by the eccentric 196 is an elongated connector 198 extending radially outward from the eccentric 196. A free end of connector 198 is operably and articulately connected to a drive member 200.

As shown in FIGS. 10 and 13, drive member 200 is mounted along a lengthwise portion of shaft 132 to which input drive gear 130 of the power train 122 is operably connected in a non-rotatable relationship. In the illustrated embodiment, and as shown in FIGS. 10 and 13, drive member 200 includes a pair of spaced arms 202 and 204 which preferably embrace and are articulately connected to the free end of the connector 198. As best illustrated in FIG. 13, arms 202 and 204 of drive member 200 radially extend away from the fixed axis 134 of shaft 132. Moreover, the location wherein the elongated connector 198 is articulately connected to the arms 202 and 204 of drive member 202 is radially spaced from the axis 134 of shaft 132.

As illustrated in FIG. 13, a conventional one-way bearing clutch 210 is operably provided between shaft 132 and drive member 200. As is well known, the one-way bearing clutch 210 readily permits drive member 200 to move or rotate relative to shaft 132 when drive member 200 is moved or rotated, as shown in FIG. 13, in a clockwise direction. Notably, however, the one-way bearing clutch 210 also serves to operably interconnect drive member 200 and shaft 132 when drive member 200 is rotated, as shown in FIG. 13, in a counterclockwise direction.

As will be appreciated from an understanding of feeding mechanism 80, upon every revolution of the eccentric 196 the connector 198 is driven in opposed endwise directions. Notably, however, only pushing movement of the eccentrically driven connector 198 on drive member 200 is converted into rotation of shaft 132 about axis 134 by way of the one-way bearing clutch 210. In turn, the rotation of shaft 132 is imparted to the input drive gear 130 of the drive system 120 and, through the power train 122, imparts opposite rotational and intermittent driving movements to the lower and upper feed rollers 82 and 84, respectively, of feeding mechanism 80.

As will be appreciated from an understanding of the intermittently operated feeding mechanism 80, when the connector 198 is endwise pulled toward the axis 26 of the main drive shaft 24 by the eccentric 196, drive member 200 will freely turn relative to and, thus, impart no rotational movement to shaft 132 as a result of the one-way bearing clutch 210. As such, and although the feed rollers 82, 84 advantageously remain in constant contact with the material passing through the sewing station of machine 10 during a sewing operation, only an intermittent drive motion, arranged in timed relation with reciprocation of the needle 30, will be imparted to the feed rollers 82, 84 of mechanism 80 during a sewing operation of machine 10.

The upper and lower feed rollers 82 and 84, respectively, of mechanism 80 are each preferably provided with a serrated peripheral edge to promote engagement and advancement of the sewn material through the sewing station of machine. Such serrated peripheral edge of the rollers 82, 84 can inadvertently snag or otherwise grab onto the sewn material moving through the machine, thus, hindering material advancement. In a most preferred embodiment, the mattress edge sewing machine is further provided with structure 230 which, in one form, is arranged immediately adjacent to the sewing station of the machine 10, for stripping material from and inhibiting the material from inadvertently remaining engaged with mechanism 80 as the material moves through the sewing station of the machine 10.

In one form, the structure 230 for stripping material from the lower feed roller 82 (FIG. 16) as the material moves through the sewing station includes cooperating instrumentalities 232 on the throat plate 17 and on the lower feed roller 84 of feed mechanism 80. In the form shown by way of example in FIGS. 14, 15, and 16, the cooperating instrumentalities 232 includes a series of fingers or tines 234 on the throat plate 17 which extend generally parallel to the direction of material feed (as indicated by arrow 42 in FIG. 15) moving through the sewing station. The series of fingers or tines 234 on the throat plate 17 are arranged in registry with an equal number of annular grooves 236 provided on the lower feed roller 82. As such, and as shown in FIG. 16, the serrated peripheral edge of the lower feed roller 82 is permitted to project through the throat plate 17 to operably engage and facilitate advancement and movement of the mattress material through the sewing station of the machine with the fingers or tines 234 cooperating with the grooves 236 in roller 82 to significantly reduce if not eliminate the likelihood the sewn material, passing from the sewing station, will inadvertently remain engaged with one or both feed rollers 82, 84 of the feed mechanism 80.

From the foregoing it will be readily appreciated and observed that numerous modifications and variations can be effected without departing from the true spirit and scope of the novel concept of the present invention. It will be appreciated, however, that the present disclosure is intended to set forth an exemplification of the present invention which is not intended to limit the invention to the specific embodiment illustrated.

What is claimed is:

1. A mattress edge sewing machine including a frame with a material supporting surface, a drive shaft revolubly mounted about a fixed axis in said frame, a sewing station defined by sewing instrumentalities including a needle carried by a needle bar mounted in said frame for generally vertical reciprocatory movements along a fixed axis and a looper reciprocally mounted for cooperative movements with said needle to form a series of chain stitches, and a feeding mechanism for pulling material along a generally horizontal direction through said sewing station, with said feeding mechanism including a lower positively driven feed roller mounted on said frame for rotation about a fixed axis arranged below said material supporting surface, an upper positively driven feed roller mounted for rotation about an axis in a manner permitting said upper feed roller to be shifted relative to said lower feed roller between a first position, wherein said upper and lower feed rollers are arranged in operable combination relative to each other to pull material along a generally horizontal direction through said sewing station, and a second position, wherein said upper and lower feed rollers are separated from operable engagement relative to each other and wherein said upper and lower feed rollers are continually biased toward each other and are mounted on said sewing machine such that a distance less than 0.8625 inches, measured in the direction of material advancement, separates the centerline of said upper and said lower feed rollers from the centerline of said needle bar.

2. The mattress edge sewing machine according to claim 1, further including a drive system operably connected to said drive shaft for positively driving each feed roller in timed relation relative to reciprocal movements of said needle bar.

3. The mattress edge sewing machine according to claim 1, wherein said drive system includes a series on intermeshing gears operably arranged between the drive shaft and the feed rollers of the feed mechanism.

4. The mattress edge sewing machine according to claim 1, wherein at least said lower feed roller has a serrated peripheral edge for facilitating engagement and advancement of the material moving through said sewing station.

5. The mattress edge sewing machine according to claim 4, wherein the material supporting surface on said machine is defined in part by a throat plate.

6. The mattress edge sewing machine according to claim 5, wherein said throat plate and said lower feed roller define cooperating instrumentalities for stripping material from the serrated peripheral edge of said upper feed roller whereby enhancing movement of the material through the machine.

7. The mattress edge sewing machine according to claim 1, further including a mechanism mounted on said sewing machine frame for vertically and selectively moving said upper feed roller relative to the material supporting surface on said sewing machine.

8. The mattress edge sewing machine according to claim 7, wherein said mechanism for vertically and selectively moving said upper feed roller relative to the material supporting surface on said sewing machine is manually operated.

9. A mattress edge chain-stitch sewing machine including a frame with a material supporting surface, a drive shaft revolubly mounted about a fixed axis in said frame, sewing instrumentalities defining a sewing station for said sewing machine and including a reciprocally driven needle carried by a needle bar mounted in said frame and operable along a fixed and generally vertical centerline and an across-the-line of feed looper mounted in operable combination with said needle for forming chain-stitches, and a feeding mechanism for advancing material beneath said needle bar and along a generally horizontal direction, said feed mechanism including a lower feed roller mounted for rotation about a fixed axis arranged below the material supporting surface of said machine, an upper feed roller biased into operable combination with said lower feed roller, with said upper feed roller being mounted for rotation about an axis in a manner permitting said upper feed roller to be shifted relative to said lower feed roller between a first position, wherein said upper and lower feed rollers are arranged in constant operable combination relative to each other to advance the material beneath the needle bar, and a second position, wherein said upper and lower feed rollers are separated from operable engagement relative to each other and wherein said upper and lower feed rollers are arranged in the line of and rearwardly of the generally vertical centerline of the needle bar by a distance less than 0.8625 inches, measured in the direction of material advancement, with said upper and lower feed rollers being positively and intermittently driven such that material advancing beneath the needle bar is moved in timed relation relative to the reciprocation of said needle bar.

10. The mattress edge sewing machine according to claim 9, wherein a drive system, operably connected to said drive shaft, positively drives each feed roller in timed relation relative to reciprocal movements of said needle bar.

11. The mattress edge sewing machine according to claim 10, wherein said drive system includes a series on intermeshing gears operably arranged between the drive shaft and the feed rollers of the feed mechanism.

12. The mattress edge sewing machine according to claim 9, wherein at least said lower feed roller has a serrated peripheral edge for facilitating engagement and advancement of the materials through said sewing station.

13. The mattress edge sewing machine according to claim 12, wherein the material supporting surface on said machine is defined in part by a throat plate.

14. The mattress edge sewing machine according to claim 13, wherein said throat plate and said lower feed roller define cooperating instrumentalities for stripping material having passed through the sewing station of the machine from remaining engaged with the feed mechanism whereby enhancing movement of the material through the machine.

15. The mattress edge sewing machine according to claim 9, wherein said upper and lower feed rollers each has a serrated peripheral edge for facilitating engagement and advancement of the material moving through said sewing station.

16. The mattress edge sewing machine according to claim 9, further including a mechanism mounted on said sewing machine frame for vertically and selectively moving said upper feed roller relative to the material supporting surface on said sewing machine.

17. The mattress edge sewing machine according to claim 16, wherein said mechanism for vertically and selectively moving said upper feed roller relative to the materials supporting surface on said sewing machine is manually operated.

18. A mattress edge chain-stitch sewing machine including a frame, a needle bar mounted for generally vertical reciprocatory movements within said frame along a fixed axis, a throat plate forming part of a material supporting surface of said machine, with said throat plate defining a working edge for said machine, and with said working edge being disposed in proximate laterally spaced relation from the fixed axis of said needle bar, a looper mounted for rocking pivotal movements laterally across the fixed axis of said needle bar, with a tip of said looper remaining to one side of the working edge of said throat plate as said looper moves across the fixed axis of said needle bar, and wherein said needle bar moves in timed relation relative to the rocking pivotal movements of said looper, and with said needle bar traversing a distance in a single vertical direction at a ratio greater than 3:1 relative to the distance in a single lateral direction traversed by said looper.

19. The mattress edge sewing machine according to claim 18, further including a mechanism for pulling materials along a generally horizontal direction and beneath the needle bar.

20. A mattress edge chain-stitch sewing machine including a frame, a needle bar mounted for generally vertical reciprocatory movements within said frame along a fixed axis, a throat plate forming part of a material supporting surface of said machine, with said throat plate defining a working edge for said sewing machine, and with said working edge being disposed in proximate laterally spaced relation from the fixed axis of said needle bar, a looper mounted for rocking pivotal movements laterally across the fixed axis of said needle bar, with a tip of said looper remaining to one side of the working edge of said throat plate as said looper moves across the fixed axis of said needle bar, and wherein said needle bar moves in timed relation relative to the rocking pivotal movements of said looper, and with said needle bar traversing a distance in a single vertical direction at a ratio greater than 2:1 relative to the distance in a single lateral direction traversed by said looper, with said sewing machine further including a mechanism for pulling material along a generally direction and beneath the needle bar, and wherein said mechanism for pulling material along a generally horizontal direction and beneath the needle bar includes a lower positively driven feed roller mounted on said frame for rotation about a fixed axis arranged below the material supporting surface of said machine, an upper positively driven feed roller mounted on said frame for rotation about an axis arranged above the material supporting surface of the machine, and wherein said upper and lower feed rollers are mounted on said sewing machine such that a distance ranging between about 0.5 inches and about 1.0 inch, measured in the direction of material advancement, separates the centerline of said upper and said lower feed rollers relative to the centerline of said needle bar.

21. The mattress edge chain-stitch sewing machine according to claim 20, wherein the upper feed roller of said mechanism is mounted on said machine in a manner permitting said upper feed roller to be shifted relative to said lower feed roller between a first position, wherein said upper and lower feed rollers are arranged in operable combination relative to each other to pull the material along a generally horizontal direction beneath said needle bar, and a second position, wherein said upper and lower feed rollers are separated from operable engagement relative to each other.

22. A mattress edge chain-stitch sewing machine having a frame, a drive shaft revolubly mounted in said frame, a needle bar driven by said shaft and reciprocal along a fixed path of travel, a throat plate arranged beneath the needle bar and forming part of a material supporting surface for said machine, with an edge of said throat plate being disposed in proximate lateral relation to said needle bar defining a working edge of said machine, and a stitch forming mechanism comprising:

stitch forming instrumentalities including a needle mounted to a lower end of said needle bar for movement along a fixed generally vertical reciprocal path of travel;

and with said stitch forming instrumentalities further including a looper arranged pivotal and across-the-line of feed movements relative to and in combination with said needle to form chain stitches in a workpiece, and with a tip of said looper remaining to one side of the working edge of said machine during a sewing operation; and wherein the needle traverses a distance in a single vertical direction at a ratio greater than 3:1 relative to the distance in a single lateral direction traversed by said looper during a single stitch forming cycle of said machine.

23. The mattress edge sewing machine according to claim 22, further including a needle guard driven in timed relation relative to said needle during the stitch forming cycle of said sewing machine.

* * * * *